US005342278A

United States Patent [19]

Kurandt

[11] Patent Number: 5,342,278

[45] Date of Patent: Aug. 30, 1994

[54] APPARATUS FOR THE ON-LINE CONTROL OF FOLDING BOX BLANKS

[75] Inventor: Fritz Kurandt, Berlin, Fed. Rep. of Germany

[73] Assignee: System Kurandt GmbH, Berlin, Fed. Rep. of Germany

[21] Appl. No.: 13,645

[22] Filed: Feb. 4, 1993

[51] Int. Cl.[5] ..... B31B 1/94; B31B 3/62; B65H 29/62

[52] U.S. Cl. ..... 493/16; 493/37

[58] Field of Search ..... 493/12, 16, 37, 125, 493/126

[56] References Cited

U.S. PATENT DOCUMENTS

| | | | |
|---|---|---|---|
| 3,389,811 | 6/1968 | Frank | 493/16 |
| 3,581,629 | 6/1971 | Wiendieck | 493/16 |
| 4,144,800 | 3/1979 | Hughes | 493/12 |
| 4,349,998 | 9/1982 | Covert | 493/16 |
| 4,917,659 | 4/1990 | Mohaupt et al. | 493/12 |
| 4,988,330 | 1/1991 | Bensberg | 493/16 |

FOREIGN PATENT DOCUMENTS

| | | | |
|---|---|---|---|
| 0321682 | 10/1988 | European Pat. Off. . | |
| 1761466 | 7/1971 | Fed. Rep. of Germany | 493/12 |
| 2709812 | 9/1977 | Fed. Rep. of Germany . | |
| 3743728 | 10/1990 | Fed. Rep. of Germany . | |

*Primary Examiner*—William E. Terrell
*Attorney, Agent, or Firm*—Barnes & Thornburg

[57] ABSTRACT

A device for on-line control and automatic ejection of faulty blanks moving along a conveyor wherein there is a linear ejector conveyor positioned laterally and at an acute angle to the conveyor direction and wherein the speed with which the faulty blanks are conveyed away by the ejector conveyor is related to the speed of the conveyor by the relationship (Conveyor Speed)=(Ejector Conveyor Speed)(Cosine of the acute angle).

15 Claims, 3 Drawing Sheets

APPARATUS FOR THE ON-LINE CONTROL OF FOLDING BOX BLANKS

Figure 1:
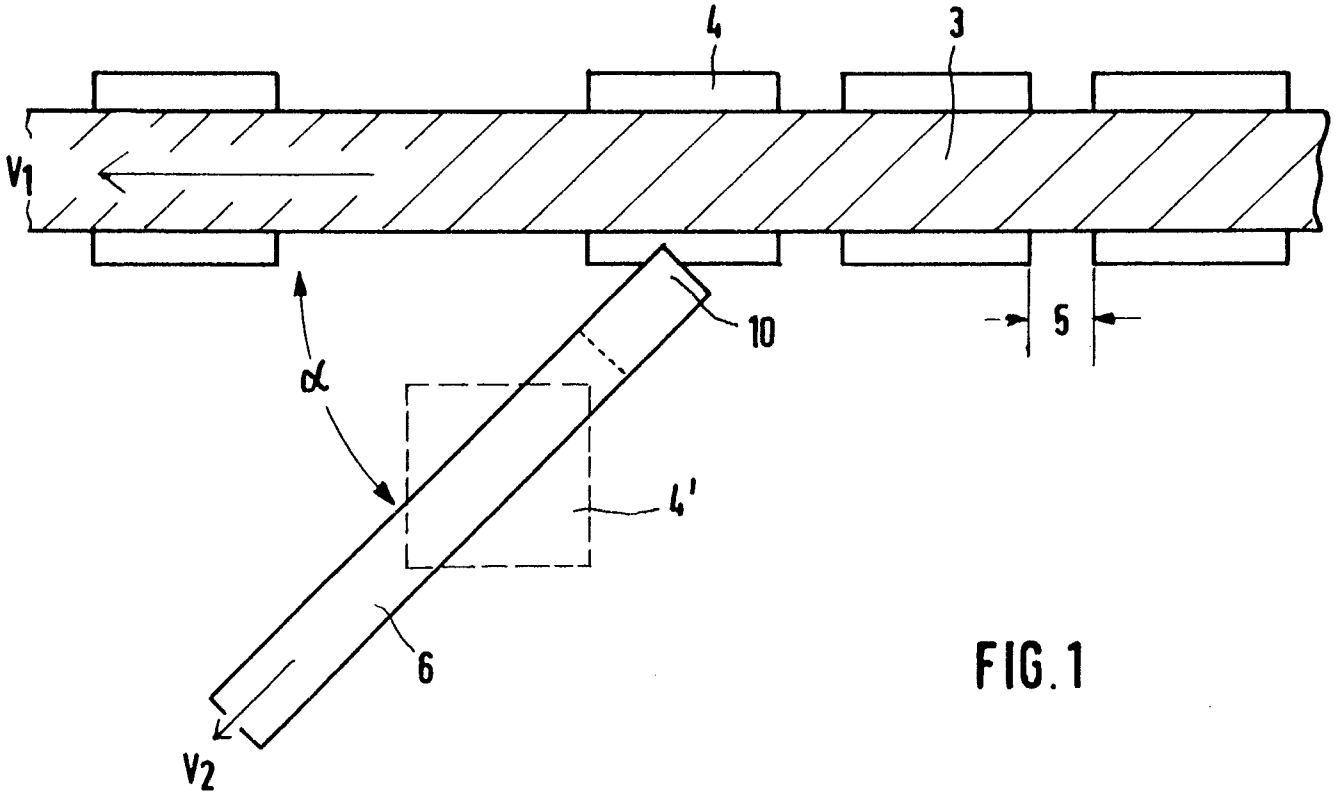

The invention relates to an apparatus for the on-line control and automatic ejection of faulty and/or incorrect folding box blanks in the manufacture of folding cardboard boxes according to the preamble of claim 1.

Folding cardboard boxes or boxes made from a similar material represent a considerable proportion of the available packing means in the packing industry. Not only is the food industry with its many different cardboard box constructions and the electrical and electronics industries, but more particularly the pharmaceutical industry are dependent thereon. Pharmaceutical products marketed in glass containers or other containers sealed in air-tight manner, as well as in film packs are generally obtainable portioned into folding cardboard boxes, whose imprints can be directly read or in coded form provide information on the box content.

Corresponding to the large numbers and the numerous different forms with which folding cardboard boxes made from blanks are marketed, the multistage manufacturing process thereof is automated to a very considerable extent. Frequently the multistage manufacturing process, starting with the printing of the flat article, the punching of the blank, the multiple folding and up to the joining together of the box, e.g. by bonding or adhering, is combined into a high performance on-line production line. The high production capacity and the high quality requirements with respect to the finished products make multiple monitoring systems necessary, which could not appropriately or economically be carried out by manual intervention into the production sequence. Any disturbance in even part of the production would lead to the stoppage of the entire production line and therefore to considerable production losses. Other problems such as e.g. misdirecting or incorrect bonding operations and the like lead to high wastage rates if there is not an adequate level of monitoring in the following process. The requirements regarding the large numbers of informations involved, such as e.g. details on the quantity and nature of the content, the shape and colouring of the coding imprints and the like are particularly important in folding cardboard boxes for the pharmaceutical industry and are largely prescribed by numerous laws and government regulations. The optical, mechanical and/or electronic monitoring means must be correspondingly accurate and fault-free and must be able without delay to detect faulty or incorrect production parameters or product components, so as to immediately eliminate any errors or discharge faulty products without any production interruption from the on-line production system.

Thus, e.g. solely into a high capacity folding box bonding machine, which only constitutes part of the automatic production line, optoelectronic bar code readers, glue line control detectors and similar monitoring means are integrated. They serve to monitor the multiple folding of the planar blank to form a six or many-sided container and the following gluing for the purpose of durably joining together to obtain the desired container shape in each production stage.

The operational reliability of such monitoring systems is dependent not only on the quality and quantity of the fault detection, but also on the elimination from the production sequence of the detected faulty article.

With the high production frequency made possible by automated production an automated fault or error detection has hitherto led to less technical problems than the elimination of the faulty parts, particularly the process of ejecting individual faulty products from the moving production line.

In this connection a so-called rotary ejector in the form of a rotary table is known in connection with folding box bonding machines (DE 3,743,728 C2). After a detector has detected an incorrect or faulty blank and whilst taking account of the time lag or the number of boxes between detection and the moving passed the rotary ejector of the blank to be removed, said blank is engaged by magnetically controlled switching rolls, supplied to a rotating ejector disk and, following carrying along over an undefined rotation angle, is ejected tangentially. As in the production sequence the detectors are installed in spatially very widely differing manner relative to the ejector, the time lags between detection and activation of the ejector must be adjusted in accordance with the particular arrangement. The rotary table of the known ejector is positioned laterally to the conveying section of the blanks and aligned in the plane thereof in such a way that the peripheral area of the disk is located immediately below or above the movement path of the blanks along said conveying section or overlaps the same. The blanks pass individually into the folding box bonding machine, i.e. with a predetermined spacing. The position of the blanks is defined in slip-free manner by force closure between the upper continuous belt and the lower continuous belt of the conveying section. The blanks project on either side of the belt conveyor so that the grasping of an incorrect or faulty blank during production is made possible by the rotary ejector mechanism. The gripper is a friction roll, which is activated when the faulty blank moves passed the rotary ejector table, so that the edge of the blank is pressed onto the surface provided with a friction layer and in this way the blank is drawn out in rotary manner between the two continuous belts of the conveying section. The continuously rotating rotary table consequently engages on activating the friction roll in each case one faulty blank at the time of passing by and with production continuing transfers its linear movement into the rotary movement of the rotary table. However, this is only ensured if the box is correctly held during its lateral displacement, otherwise there can be an undefined lateral displacement without a complete discharge.

The rotary movement of the faulty box not only requires specific pressure and friction values, but also a spacing between the successive blanks in the conveyor system and which must roughly correspond to at least the difference between the diagonal length of the blank and its width. Therefore special requirements are made on the individualizing of the blanks, i.e. the spacing of the individual blanks, which leads to a reduction of the production capacity of the entire machine system. In addition, the rotation angle over which the faulty blank is carried along by the rotary table of the rotary ejector is not defined, because it is dependent not on the size, but on the surface characteristics and weight of the blank, so that there can be widely differing friction driving forces and torques. The resulting unavoidable, uncontrolled ejection direction not infrequently leads to machine problems, which can further reduce the production capacity of the overall installation. The frictional connection between the activated friction roll and rotary table over different arc lengths, as a function of the blank dimensioning, necessary for carrying or driving along a faulty blank, in accordance with the setting of the rotary ejector, is only ensured for specific dimensional ranges in the blank dimensions and its cardboard thickness. It has also been found that on increasing the production speed along the conveying section it is not always possible to ensure a reliable engagement of the blanks between the friction roll and the rotary table. Such blanks can then be carried along by the continuous production in partly displaced and partly turned manner, so that ultimately faults occur, which can lead to the disconnection of the entire automated on-line system.

Reference is finally made to another known device for the sorting out of predetermined box blanks from a plurality of continuously delivered blanks (DE-OS 2,709,812) in which a ram is used for ejecting vertically upwards out of the conveyor plane faulty blanks, so as to be engaged by a belt conveyor, constituted by an upper and a lower belt, deflected and transported away in the opposite conveying direction. However, for this purpose the boxes or similar blanks must be adequately individualized in the ejection area, so as to ensure that succeeding, faultless blanks are not unintentionally also ejected. Therefore, in this known device the delivery capacity for the purpose of a fully automatic high performance process is very limited.

The problem of the present invention is to provide an ejector for an at least partly automated on-line production systems for the production of folding cardboard boxes from corresponding blanks, in which a pivoting, deflecting or rotary movement of the blank to be removed from the production line is avoided, so that the disadvantages caused by this are obviated so that, whilst obtaining a reliable removal, the hitherto necessary increased demands made on the machine operating personnel are avoided.

According to the invention this problem is solved by the features of the characterizing part of claim 1. Advantageous further developments are disclosed by the subclaims.

Due to the fact that the blank ejector according to the invention with respect to the manufacture of folding cardboard boxes only performs translatory movements instead of the hitherto necessary deflecting or pivoting movements with the blank to be ejected, it is also possible to minimize the spacing between the blanks supplied on the linear conveying section, also in scale flow and consequently the production speed can be increased. Particularly in the case of large sizes, there is no need to respect an increased spacing between the boxes caused by the circular measure of the ejector. The ejection of the blank takes place in controlled manner with an accurately defined, predetermined ejection direction and removal speed by means of a linear conveyor in the given conveying plane. The engagement of faulty blanks is independent of their thickness, surface characteristics, size and weight. An accurate and precisely defined ejection of faulty blanks is ensured, independently of their characteristics. According to the invention, the troublefree ejection is achieved by synchronizing the speed of the linear conveying section of the blanks along the production line on the one hand and the linear speed of the ejector at an angle to the production direction and conveying in the plane thereof on the other. The matching of said two speeds is only dependent on the angle defined between the two linear movements in the same plane, as described hereinbefore. Once the system has been set up, there is generally no further change to the angle.

The invention is described in greater detail hereinafter relative to non-limitative embodiments and the attached drawings, wherein show:

FIG. 1 a diagrammatic plan view of part of the conveying section of a folding box bonding machine with the linear ejector according to the invention.

Figure 2:
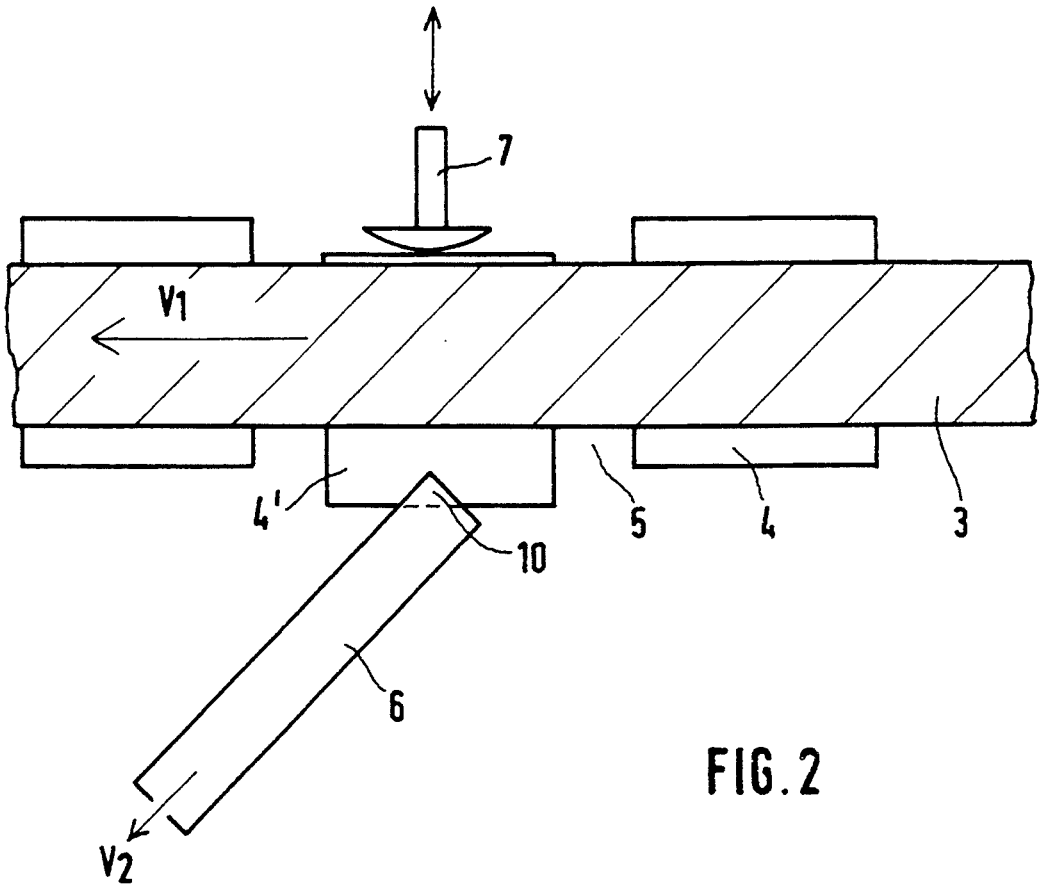

FIG. 2 a view corresponding to FIG. 1 with an additional ram ejector.

Figure 3:
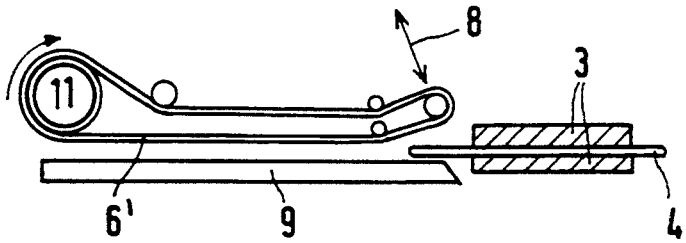

FIG. 3 diagrammatically a vertical longitudinal section through an embodiment of a linear ejector with the associated conveying section.

Figure 4:
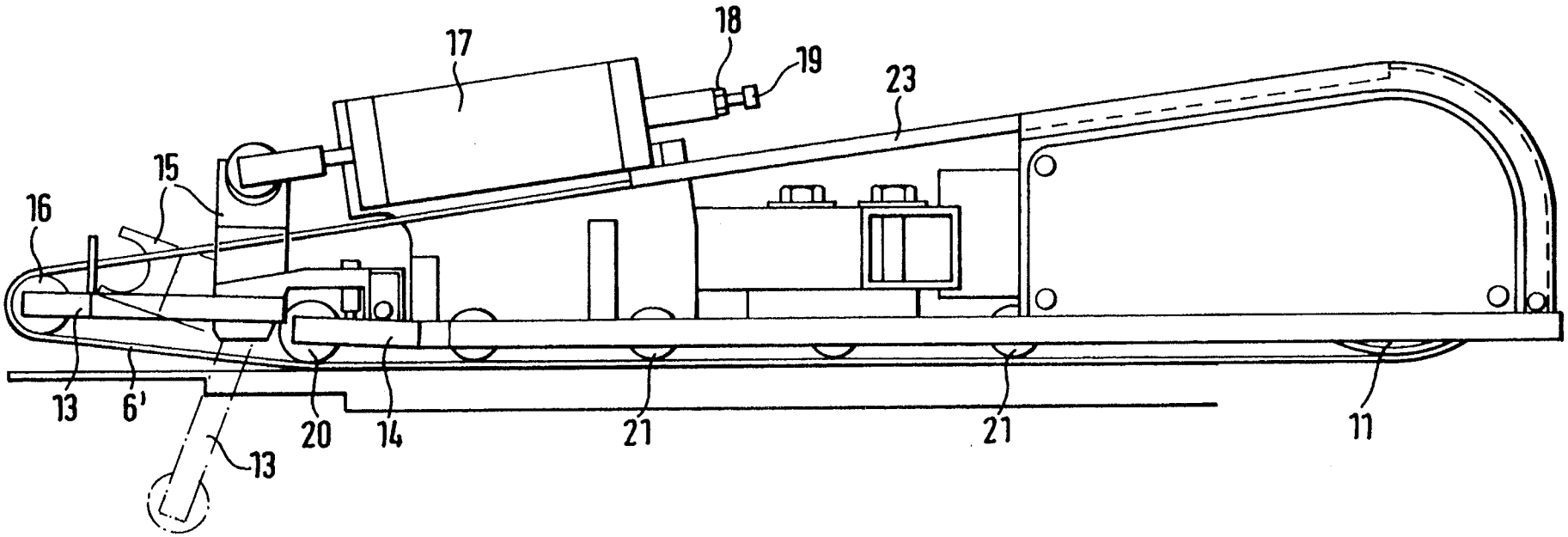

FIG. 4 a lateral plan view according to FIG. 3 in greater detail.

As can be gathered from the drawings, movement takes place along a conveying section 3 in individualized form and with the reciprocal spacing 5 of blanks 4 for the production of folding cardboard boxes and at a speed $V_1$ in the arrow direction in the conveying plane. Standard production speeds are 300 to 600 m/min. The conveying section 3 comprises a double belt arrangement, i.e. two closely superimposed continuous conveyor belts, which revolve at the same speed in the direction of the arrows and by friction hold in clearly defined form the individual blanks 4. Laterally and at an acute setting angle $\alpha$ to the translatory movement of the blanks 4 along the conveying section 3 in the conveying plane, a fixed rail arrangement 9 with a conveyor belt 6 for transporting away faulty blanks 4' is brought into position in the represented form and the ejector belt moves in the arrow direction at the speed $V_2$. The gripper mechanism not shown in detail in FIG. 1 engages the blank 4' at the start of the linear ejector, which is positioned in such a way that its area 10 adjacent to the conveying section 3 is aligned below or above the marginal area of the blanks 4, the conveying plane of the linear ejector 6, 8, 9 being located in the conveying plane of the conveying section 3. The in plan view overlapping portion between the area 10 of the linear ejector 6, 8, 9 and the particular marginal area of a blank 4 is with said orientation such that there are no contact problems for the blanks 4 along the conveying direction of the on-line system. Only for the case that one or more of the not shown detectors detects a blank as being incorrect, faulty or incorrectly printed, is a gripper mechanism 7, 8 activated at the time when said blank 4' passes by the linear ejector and as a result said blank is pressed indirectly by friction on the area 10 or it is moved by linear movement further towards said area until, in the movement direction and in the same movement plane of the linear ejector and in the case of an exclusively translatory movement, it is carried along at the speed $V_2$.

For the troublefree operation of the linear ejector according to the invention it is important that it is at an acute setting angle $\alpha$ with respect to the two described translatory movement directions, the conveying direction between the conveying section 3 and that of the linear ejector being matched to one another in accordance with the formula:

$$V_2 = \frac{V_1}{\cos \alpha}$$

The linear ejector conveyor belt 6 consequently rotates at a higher speed than the production speed given by the conveying section 3 and namely as a function of the setting angle $\alpha$. Thus, in the case of a linear ejector, which is set laterally e.g. at an angle $\alpha=45°$ to the conveying section, a linear ejecting speed $V_2$ is obtained of $$\frac{V_1}{\cos 45°} = \frac{1}{0.707} = 1.4$$

The ejection speed is in this embodiment greater by a factor of 1.4 than the conveying speed of the blanks 4 along the production line. Thus, the projection speed of the ejector on the conveying section corresponds to this speed, so that the faulty blank 4' during the linear lateral extraction from the conveying section 3 in the conveying plane or at least approximately in the latter is moved with the speed of the conveying section 3 between its blank upstream and its blank downstream in the conveying direction without being subject to any acceleratory, deceleratory or deflecting movement. Therefore the spacing 5 of the individual blanks 4 or optionally a given overlap spacing in a scale flow of blanks can be minimized completely independently of the ejection process by the production sequences determining the individualization.

FIGS. 2 and 3 show embodiments for possible ejectors for faulty blanks 4' from the conveying section 3. According to the embodiment of FIG. 2 activation takes place of a ram 7, which is moved backwards and forwards in translatory manner in the direction of the double arrow, if a not shown measuring and checking device, i.e. a suitable code reader has previously detected a faulty blank 4' and a corresponding ram actuation signal has been transmitted, whilst taking account of the time lag between the fault detection and the faulty blank moving passed the linear ejector. The represented activated, i.e. extended position of the ram 7 only exists for at the most a fraction of the passage length of a blank, calculated for the minimum blank length. In the non-activated position the ram is retracted outside the movement range of the blank sequence. The faulty blank 4' moved by means of the ram 7 into the gripper range of the linear ejector is gripped by the same and with an increased speed $V_2$, which as the projection speed, taking account of the angle $\alpha$ in the direction of the conveying movement corresponds to the speed of the conveying section 3, substantially remaining in the conveying plane, is carried along and ejected precisely in the direction of the slide rail 9. Thus, the ram 7 forces the faulty blank out of the conveying direction to such an extent that it necessarily runs into the laterally inclined ejector belt and by friction with said belt is conveyed slidingly away on the rails 9.

In the embodiment according to FIG. 3 the entrance portion 19, i.e. the portion 8 of the ejector belt 6 adjacent to the conveying section 3 is pivotable, so that it can be moved towards and away from the blank 4'. This pivotable portion 8 is pivoted downwards for ejecting a faulty blank 4' until it fixes the blank between it and the low-friction surface of the slide rails 9 or a corresponding guide plate and consequently draws the blank out of the conveying section 3 by frictional coupling. In this embodiment the linear conveyor comprises the endless belt 6' revolving at the speed $V_2$ and which is driven by the motor 11 and the low-friction coated guide rail 9. In the embodiment according to figs. ½ the linear conveyor can comprise two closely spaced, revolving continuous belts, corresponding to the conveying section 3, and which according to FIG. 3 also comprises two closely spaced, synchronously revolving continuous belts 3. The continuous belts to a certain extent squeeze the blanks 4 between them.

It is also conceivable to have other gripper mechanisms in the area 10 of the linear conveyor and the adjacent conveying section 3 in place of the ram 7 or the one-side engaging conveyor belt 6'.

The use according to the invention of the conveyor belt 6' which is foldable in the represented portion 8 is particularly advantageous, because this ensures a continuous transfer between the gripper function and the conveyor function.

FIG. 4 shows the linear conveyor according to the invention in a lateral plan view and in greater detail. The continuous belt 6' ejecting a faulty blank is consequently guided in the vicinity of the pivotably constructed portion 8 according to FIG. 3 on the one hand about a folding pulley 16 and on the other about a guide pulley associated with the motor 11. The lower strand of the ejecting belt 6' is positionally defined by a plurality of spaced idler pulleys 21. Between the lower strand and the slide or guide rail 9 can be adjustably defined a spacing, said adjustment being performed as a function of the thickness of the blanks. The surface of the slide rail 9 is treated in such a way that it allows no friction with the blank, whereas the surface of the ejecting belt 6' has a maximum high friction coefficient compared with the blank to be ejected. The ejecting belt 6' could be pretensioned in advantageous manner over the tension pulley 20, which is mounted on the free, pivotable end of a gripping lever 14, in such a way that the folding pulley 16 is held in tension-loaded manner in its two positions, namely a lower, not shown ejecting position and the shown, inactive position. The folding pulley 16 is firmly connected to a rocking lever 15 by means of the folding lever 13 and is pivotable together therewith about a fulcrum. The pivoting movement takes place by means of an electromagnet 17 via its operating ram 22. On the free end of the ram 22 is mounted a ram pulley 24, which engages in a trunnion bearing of the free end of the rocking lever 15. The travel of the actuating ram 22 for giving the passive and active position of the folding lever 13 can be precisely predetermined by loosening a lock nut 18 by means of the setscrew 19. With the pivoting movement of the folding lever 13 and therefore the folding pulley 16 from the represented, inactive, i.e. non-ejecting position, into a lower, active position engaging a faulty blank, the tension of the ejecting belt 6' set by means of the tension pulley 20 must be increased over a maximum value, so that it can again be subject to the initial tension in the ejecting position. In the not shown, activated ejecting position the relevant portion of the continuous belt 6', in accordance with the lower guide rail, is parallel thereto and aligned with the complete lower strand of the belt.

The folding lever 13 and the rocking lever 15 rigidly connected thereto, but pivotable about a common fulcrum are shown in FIG. 4 with a dot-dash line guide in the position in which the ejecting belt 6' can be fitted or removed with respect to the linear ejector in tension-free manner. A covering hood 23 surrounds the non-pivotable part of the linear ejector.

The relatively short pivoting movement of the foldable, front portion of the linear ejector by means of the folding lever 13 on overcoming a tension passing through a maximum of the ejecting belt 6' pretensioned in the two end positions can take place at high speed, because it does not lead to inert masses. Due to the elasticity of the ejecting belt 6' the belt tensions which can be optimized for the operation can be adjusted by means of the tension pulley 20 and can be readjusted if the belt is subject to a certain fatigue.

The friction-increasing surface coating of the continuous belt 6' is only used during the ejection of a faulty blank, which ensures that it has a long life. The electromagnet 17 is constructed as a double magnet, i.e. restoring spring tensions are not required, which additionally shortens the necessary operating times. These mechanical measures and the pulse-like control of the two magnets with a clearly defined overvoltage (rapid energizing) leads to very constant operating times in the ms range. In addition, the operating time is accurately followed by an electronic compensating circuit as a function of the conveying speed.

The reciprocal matching of the speed $V_2$ with which faulty blanks are ejected, and the conveying speed $V_1$ consequently takes place by means of a control loop using an actual/desired value control, in such a way that the ejecting speed always represents a function $V_2=f(V_1)$ of the conveying speed, diverging with the relation $V_1=V_2 \cos \alpha$ from the actually measured values.

I claim:

1. A device for the on-line control and automatic ejection of faulty folding box blanks moving in a linear direction at a speed $V_1$ along a conveyor plane on a linear conveyor system by at least one ejector positioned laterally of the linear conveyor system and engageable with the faulty blank to be ejected in order to remove an undesired blank from the linear conveyor system comprising:

a linear conveyor system for moving the blanks in a linear direction alone a conveying plane at a speed $V_1$; a linear ejector (6) conveyor positioned substantially in the conveying plane and at an acute angle x to the conveying direction and moving at a speed $V_2$; and wherein the speed $V_1$ of the blank on the conveyor and the speed $V_2$ of the ejector conveyor are substantially related to the acute angle $\propto$ by the relationship:

$$V_1=V_2 \cos \propto$$

so as to provide that the blanks to be ejected continue to have a speed $V_1$ in the linear direction as the blanks are ejected.

2. A device according to claim 1, wherein the linear ejector (6) comprises:

a belt conveyor with a high friction coefficient engageable with the blanks moving along the convey system (3) and substantially aligned in the plane of the conveyor system; and a fixed rail with a limited friction coefficient cooperating with the belt conveyor to eject the faulty blanks.

3. A device according to claim 2, wherein the belt conveyor has an intake section (8) adjacent to the conveyor system (3) that can be pivoted to grip the faulty blanks.

4. A device according to claim 3, wherein the pivotable inlet (8) comprises a folding lever (13) with a folding pulley (16) positioned by an electromagnet (17).

5. A device according to claim 2, wherein the pivotable inlet section (8) is overengaged by an ejecting belt (6').

6. A device according to claim 5, wherein the pivotal outlet (8) comprises a folding lever connected with a folding pulley positioned by an electromagnet.

7. A device according to claim 1, wherein the linear ejector has a gripper means located adjacent the conveyor system.

8. A device according to claim 1, wherein the conveyor system (3) comprises two closely spaced, superimposed continuous conveyor belts, which receive the blanks (4,4') between them.

9. A device according to claim 8, wherein the linear ejector (16) comprises two closely spaced superimposed continuous conveyor belts for receiving the faulty blanks between them.

10. A device according to claim 1, wherein the linear ejector (6) includes a ram (7) provided at the side of the conveyor system for moving the faulty blanks in a direction away from the linear direction.

11. A device according to claim 1, wherein the linear ejector (6) has an intake section (8) located adjacent to the conveyor system which intake section can be pivoted to grip the faulty blanks.

12. A device according to claim 11, wherein the pivotable inlet section (8) is overengaged by an ejecting belt (6').

13. A device according to claim 10, wherein the pivotal outlet (8) comprises a folding lever connected with a folding pulley positioned by an electromagnet.

14. A device according to claim 1, wherein the linear ejector (16) comprises two closely spaced superimposed continuous conveyor belts for receiving the faulty blanks between them.

15. A device according to anyone of claims 2–6 and 12–13, wherein pretension means are provided to pretension the belt conveyor (6') and adjusting means are provided to adjust the internal spacing between the belt (6') and the slide rail (9).

* * * * *